US010538092B2

(12) United States Patent
Miyashita et al.

(10) Patent No.: US 10,538,092 B2
(45) **Date of Patent: *Jan. 21, 2020**

(54) LIQUID SUPPLYING MECHANISM, AND LIQUID EJECTION APPARATUS

(71) Applicant: CANON KABUSHIKI KAISHA, Tokyo (JP)

(72) Inventors: Takeho Miyashita, Yokohama (JP); Ryo Shimamura, Yokohama (JP); Akira Shiba, Machida (JP); Kazuya Yoshii, Yokohama (JP); Norihiro Ikebe, Kawasaki (JP); Tomoki Yamamuro, Kawasaki (JP); Atsushi Arai, Yokohama (JP); Masatoshi Ohira, Fujisawa (JP); Tatsuaki Orihara, Tokyo (JP); Hirofumi Okuhara, Tokyo (JP); Kazumasa Matsushita, Kawasaki (JP); Misato Furuya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/520,245

(22) Filed: Jul. 23, 2019

(65) Prior Publication Data

US 2019/0344577 A1 Nov. 14, 2019

Related U.S. Application Data

(63) Continuation of application No. 15/625,960, filed on Jun. 16, 2017, now Pat. No. 10,399,347.

(30) Foreign Application Priority Data

Jun. 29, 2016 (JP) ..... 2016-128728
Mar. 29, 2017 (JP) ..... 2017-065461

(51) Int. Cl.
*B41J 2/175* (2006.01)
*B41J 2/165* (2006.01)

(52) U.S. Cl.
CPC ..... *B41J 2/17523* (2013.01); *B41J 2/17506* (2013.01); *B41J 2/17553* (2013.01); *B41J 2/165* (2013.01)

(58) Field of Classification Search
CPC ..... B41J 2/17523; B41J 2/17506; B41J 2/17553; B41J 2/175; B41J 2/165
See application file for complete search history.

(56) References Cited

U.S. PATENT DOCUMENTS 5,162,817 A 11/1992 Tajika et al. ..... 347/7
5,179,389 A 1/1993 Arai et al. ..... 347/7
(Continued)

FOREIGN PATENT DOCUMENTS

JP 2012-020497 2/2012

*Primary Examiner* — Thinh H Nguyen
(74) *Attorney, Agent, or Firm* — Venable LLP

(57) ABSTRACT

A liquid supplying mechanism includes: a tank including a liquid storage section configured to store a liquid, and a liquid injection port configured to inject the liquid into the liquid storage section; and a bottle configured to replenish the liquid into the tank. The bottle includes: a bottle section configured to store the liquid; and a protruding section, which protrudes from the bottle section, and is insertable into the liquid injection port so as to inject, into the liquid storage section, the liquid stored in the bottle section. The liquid injection port includes: a protruding section insertion portion into which the protruding section of the bottle is insertable; and a protruding section fixing portion, which is engageable with the protruding section of the bottle, to thereby be capable of fixing the bottle to the tank.

10 Claims, 10 Drawing Sheets

(56) References Cited

U.S. PATENT DOCUMENTS

| | | | | |
|---|---|---|---|---|
| 5,355,158 | A | 10/1994 | Inada et al. | 347/22 |
| 5,381,169 | A | 1/1995 | Arai et al. | 347/33 |
| 5,398,054 | A | 3/1995 | Fukazawa et al. | 347/33 |
| 5,534,898 | A | 7/1996 | Kashino et al. | 347/33 |
| 5,606,354 | A | 2/1997 | Bekki et al. | 347/33 |
| 5,646,655 | A | 7/1997 | Iwasaki et al. | 347/17 |
| 5,748,207 | A | 5/1998 | Inui et al. | 347/43 |
| 5,777,649 | A | 7/1998 | Otsuka et al. | 347/94 |
| 5,831,652 | A | 11/1998 | Hinami et al. | 347/86 |
| 5,980,021 | A | 11/1999 | Nagoshi et al. | 347/49 |
| 5,984,449 | A | 11/1999 | Tajika et al. | 347/15 |
| 5,988,783 | A | 11/1999 | Tajika et al. | 347/7 |
| 6,015,203 | A | 1/2000 | Arai et al. | 347/33 |
| 6,050,669 | A | 4/2000 | Yano et al. | 347/23 |
| 6,241,350 | B1 | 6/2001 | Otsuka et al. | 347/94 |
| 6,345,888 | B1 | 2/2002 | Matsumoto et al. | 347/86 |
| 6,402,308 | B1 | 6/2002 | Hattori et al. | 347/86 |
| 6,476,926 | B1 | 11/2002 | Yano et al. | 358/1.14 |
| 6,505,923 | B1 | 1/2003 | Yamamoto et al. | 347/85 |
| 6,719,395 | B2 | 4/2004 | Iwasaki et al. | 347/19 |
| 7,387,216 | B1 * | 6/2008 | Smith | B01L 3/50825 215/DIG. 3 |
| 7,393,088 | B2 | 7/2008 | Sasaki | 347/84 |
| 8,454,139 | B2 | 6/2013 | Ishizawa et al. | 347/85 |
| 8,529,035 | B2 | 9/2013 | Tsukamoto et al. | 347/86 |
| 8,529,037 | B2 | 9/2013 | Miyashita et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 8,960,875 | B2 | 2/2015 | Shiba et al. | 347/93 |
| 9,016,842 | B2 | 4/2015 | Miyashita et al. | 347/86 |
| 9,139,012 | B2 | 9/2015 | Yamada et al. | B41J 2/17553 |
| 9,242,471 | B2 | 1/2016 | Yoneda et al. | B23P 19/027 |
| 9,278,540 | B2 | 3/2016 | Seki et al. | B41J 2/17513 |
| 9,375,938 | B2 | 6/2016 | Kondo et al. | B41J 2/17513 |
| 9,597,884 | B2 | 3/2017 | Nanjo et al. | B41J 2/17546 |
| 9,718,276 | B2 | 8/2017 | Tomoguchi | B41J 2/17553 |
| 2011/0209335 | A1 | 9/2011 | Yamamoto et al. | 29/505 |
| 2015/0343793 | A1 | 12/2015 | Takada et al. | B41J 2/17556 |
| 2015/0352851 | A1 | 12/2015 | Shiba et al. | B41J 2/17513 |
| 2016/0200114 | A1 | 7/2016 | Nanjo et al. | B41J 2/17546 |
| 2016/0347078 | A1 | 12/2016 | Kato et al. | B41J 2/175 |
| 2017/0087863 | A1 | 3/2017 | Miyashita et al. | B41J 2/17553 |
| 2017/0096010 | A1 | 4/2017 | Nanjo et al. | B41J 2/17546 |
| 2017/0120606 | A1 | 5/2017 | Koshikawa et al. | B41J 2/1754 |
| 2017/0120613 | A1 | 5/2017 | Ikebe et al. | B41J 2/17553 |
| 2017/0136776 | A1 | 5/2017 | Shiba et al. | B41J 2/17566 |
| 2017/0151797 | A1 | 6/2017 | Hayashi et al. | B41J 2/17513 |
| 2017/0151803 | A1 | 6/2017 | Yoshii et al. | B41J 2/17566 |
| 2017/0305164 | A1 | 10/2017 | Orihara et al. | B41J 2/17523 |
| 2017/0305165 | A1 | 10/2017 | Ikebe et al. | B41J 2/17523 |
| 2017/0305166 | A1 | 10/2017 | Shimamura et al. | B41J 2/17523 |
| 2017/0326882 | A1 | 11/2017 | Okude et al. | B41J 2/17506 |
| 2017/0361619 | A1 | 12/2017 | Arai et al. | B41J 2/17523 |

* cited by examiner

FIG. 9A1
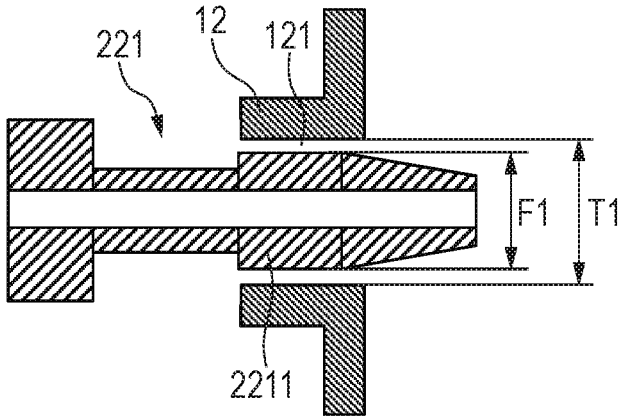
FIG. 9A2
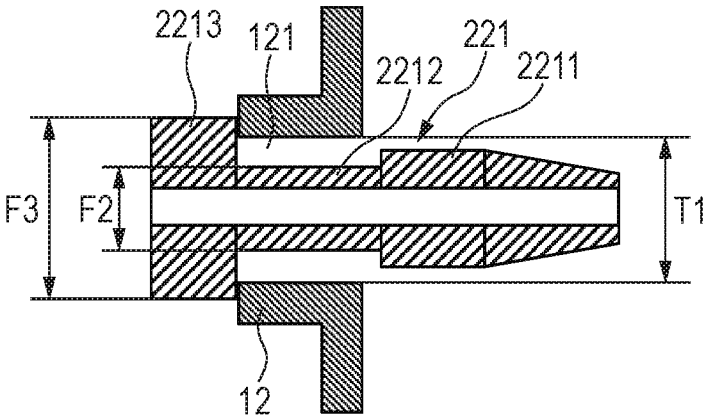
FIG. 9B
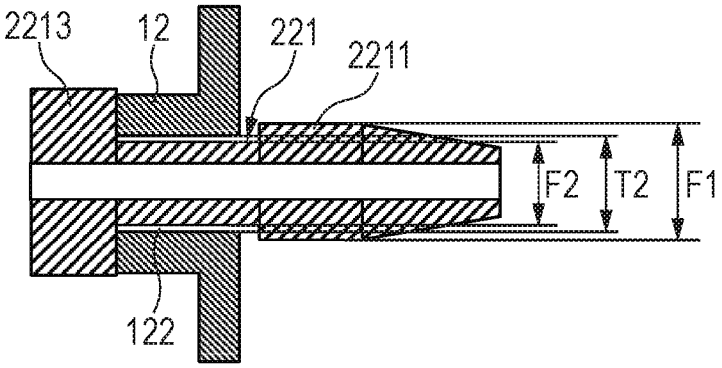

LIQUID SUPPLYING MECHANISM, AND LIQUID EJECTION APPARATUS

This application is a continuation of application Ser. No. 15/625,960 filed Jun. 16, 2017, now pending, and claims priority under 35 U.S.C. § 119 to Japan Application JP 2016-128728 filed in Japan on Jun. 29, 2016 and Japan Application JP 2017-065461 filed in Japan on Mar. 29, 2017; and the contents of all of which are incorporated herein by reference as if set forth in full.

BACKGROUND OF THE INVENTION

Field of the Invention

The present invention relates to a liquid supplying mechanism, and a liquid ejection apparatus.

Description of the Related Art

A liquid ejection apparatus, such as an ink jet recording apparatus, supplies a liquid in a liquid storage container into a liquid ejection head through a tube, and then ejects the liquid out of the liquid ejection head, thereby performing recording of images, characters, or the like on a recording medium or the like. As an example of the liquid storage container, there is known a cartridge-type liquid storage container that is removably mountable to an apparatus main body and is replaced with another liquid storage container when the liquid is replenished. Further, there is known a tank-type liquid storage container that can store a larger volume of the liquid than the removably-mountable-type liquid storage container and is directly fixed to the apparatus main body. In an apparatus including the tank-type liquid storage container, the liquid is replenished by injecting the liquid into the tank from a bottle storing a liquid for replenishment (see Japanese Patent Application Laid-Open No. 2012-20497).

SUMMARY OF THE INVENTION

According to one embodiment of the present invention, there is provided a liquid supplying mechanism, including: a tank including: a liquid storage section configured to store a liquid; and a liquid injection port configured to inject the liquid into the liquid storage section; and a bottle configured to replenish the liquid into the tank, the bottle including: a bottle section configured to store the liquid; and a protruding section, which protrudes from the bottle section, and is insertable into the liquid injection port so as to inject, into the liquid storage section, the liquid stored in the bottle section, the liquid injection port including: a protruding section insertion portion into which the protruding section of the bottle is insertable; and a protruding section fixing portion, which is engageable with the protruding section of the bottle, to thereby be capable of fixing the bottle to the tank.

Further features of the present invention will become apparent from the following description of exemplary embodiments with reference to the attached drawings.

BRIEF DESCRIPTION OF THE DRAWINGS

FIG. 9A1, FIG. 9A2, and FIG. 9B are schematic sectional views for sequentially illustrating features of the liquid supplying method according to the first embodiment of the present invention.

DESCRIPTION OF THE EMBODIMENTS

Preferred embodiments of the present invention will now be described in detail in accordance with the accompanying drawings.

Into the tank-type liquid storage container disclosed in Japanese Patent Application Laid-Open No. 2012-20497, the liquid is injected by a user from a bottle for replenishment when the liquid is replenished. That is, the tank-type liquid storage container and the bottle for replenishment construct a liquid supplying mechanism. In this configuration, the liquid is injected under a state in which a protruding portion of a distal end of the bottle is inserted into a liquid injection port of a tank. If the protruding portion of the bottle slips out of the liquid injection port, the liquid leaks. Accordingly, a user needs to hold the bottle immobile until injection of the liquid is finished. In particular, in a case where a tank with a large volume is used in view of printing cost reduction or the like, when it is intended to inject the liquid into the tank at a time, a user needs to hold the bottle for a long period of time. Accordingly, a large burden is imposed on a user.

Therefore, it is an object of the present invention to provide a liquid supplying mechanism, and a liquid ejection apparatus that have a low risk of leakage of a liquid, and enable a user to easily replenish the liquid.

Now, embodiments of the present invention are described.

Figure 1:
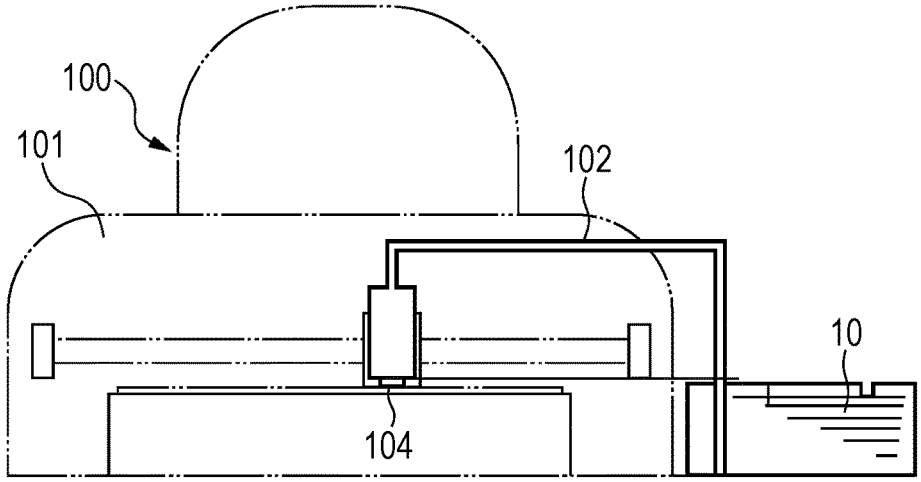
FIG. 1 is a schematic view for illustrating a liquid ejection apparatus according to the present invention.

FIG. 1 is a schematic view for illustrating a liquid ejection apparatus including a liquid storage container according to the present invention. A liquid ejection head 104 configured to eject a liquid (ink), and a tank-type liquid storage container (also simply referred to as "tank") 10 configured to store the ink are mounted to an apparatus main body 101 of a liquid ejection apparatus 100. The tank 10 is directly fixed to the apparatus main body 101. The liquid ejection head 104 and the tank 10 are connected to each other through a flexible tube 102. In the example illustrated in FIG. 1, the tank 10 is mounted to an outer side of the apparatus main body 101. However, the tank 10 may be mounted inside the apparatus main body 101.

First Embodiment

Figure 2:
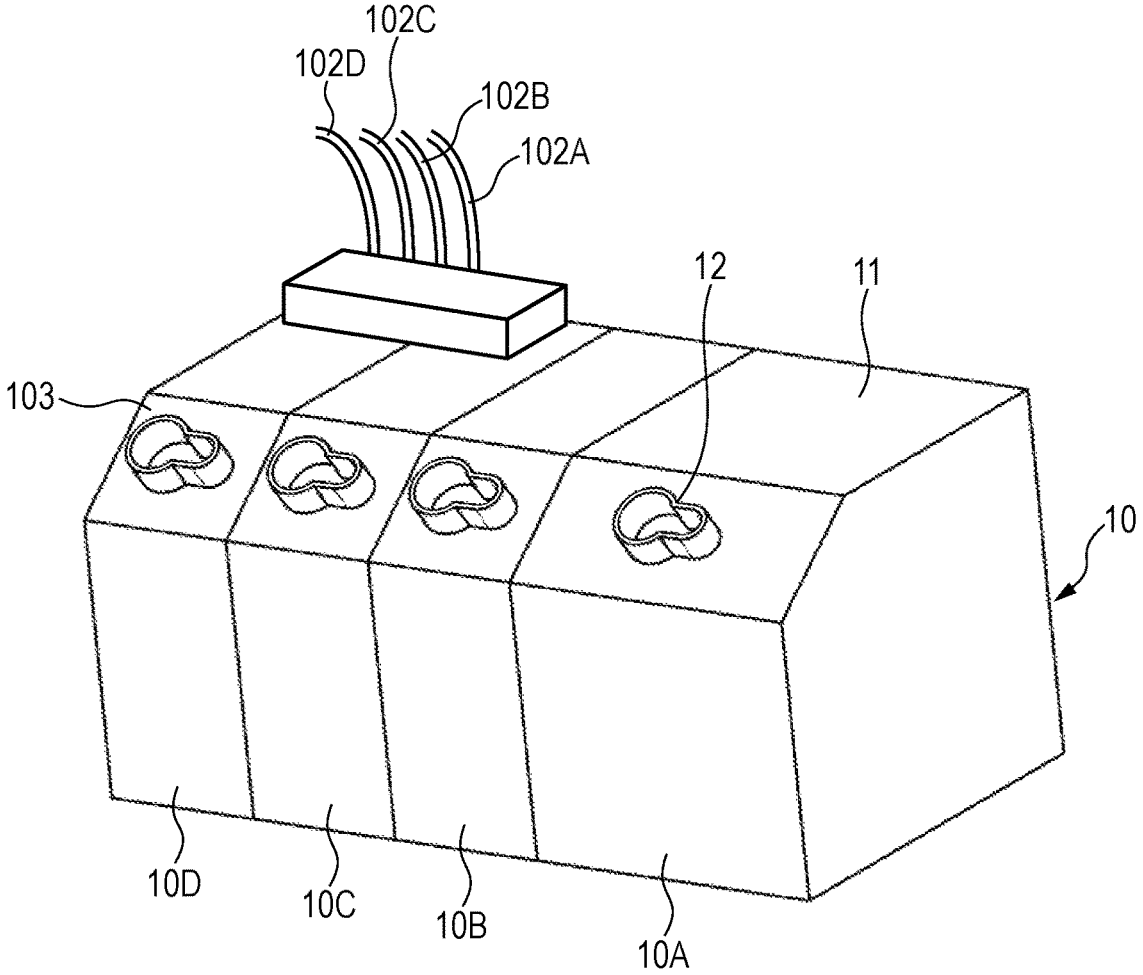
FIG. 2 is a perspective view for illustrating liquid storage containers according to a first embodiment of the present invention.

Next, a configuration of the tank 10 illustrated in FIG. 2 is described. In a first embodiment of the present invention, four tanks 10A to 10D are arranged so as to be respectively allotted for colors of inks to be ejected, and corresponding flexible tubes 102A to 102D are connected to the four tanks, respectively. Each of the flexible tubes supplies, into the liquid ejection head 104, a liquid stored in the tank 10 connected thereto. When the respective tanks and the respective flexible tubes are specified, the respective tanks and the respective flexible tubes are represented by reference numerals 10 and 102 with suffixes A to D. In one example, four color liquids, specifically, black, magenta, cyan, and yellow liquids are stored in the tanks 10A to 10D, respectively, and the four flexible tubes 102A to 102D respectively connected to the tanks 10A to 10D extend in a bundled state. The four tanks 10A to 10D have the same configuration. In the following, the configuration of one of the tanks 10 is described, but the description thereof holds true for any of the tanks 10A to 10D.

Figure 3:
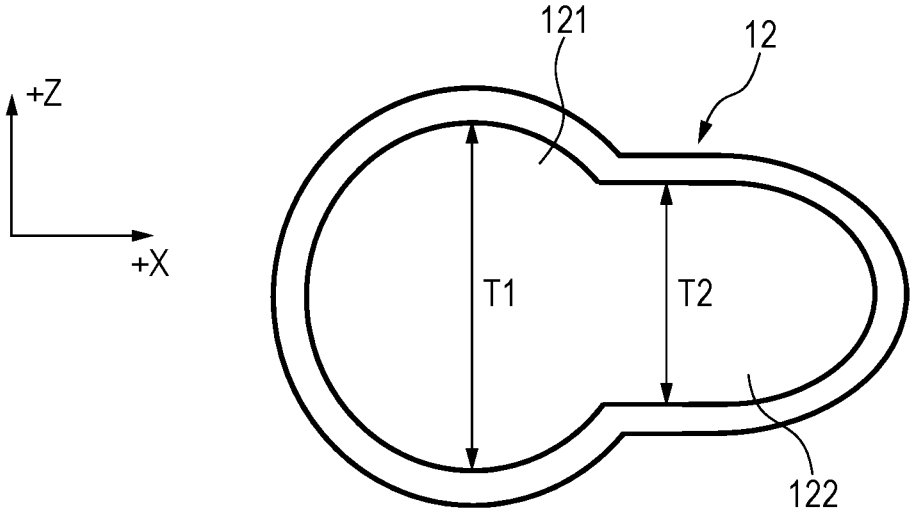
FIG. 3 is a plan view for illustrating a liquid injection port of one liquid storage container of FIG. 2.

The tank 10 includes a liquid storage section 11 configured to store the liquid to be supplied into the liquid ejection head, and a liquid injection port 12 configured to inject the liquid into the liquid storage section 11. Except during injection of the liquid, in order to prevent leakage of the liquid, the liquid injection port 12 is closed by a lid member 13 (see FIG. 7, and not shown in FIG. 2). As illustrated in FIG. 3 that is a schematic enlarged view for illustrating the liquid injection port 12 seen from an outer side thereof, the liquid injection port 12 of the tank 10 includes a protruding section insertion portion 121 and a protruding section fixing portion 122 that are formed continuously with each other to be open in the same surface of the tank 10. As described later in detail, the protruding section fixing portion 122 is configured to fix a protruding section 221 of a bottle 20 illustrated in FIG. 4 into the liquid injection port 12 by being engaged with the protruding section 221. That is, even when a force is applied to the bottle 20 in a separating (falling) direction from the tank 10, a portion of the protruding section 221 is caught on the protruding section fixing portion 122, and thus the bottle 20 is fixed to the tank 10. For example, the protruding section fixing portion 122 has an opening width smaller than a maximum outer diameter of a distal end portion of the bottle 20. The liquid injection port 12 has such a laterally asymmetrical shape that the protruding section fixing portion 122 extending sideway is joined to a part of the protruding section insertion portion 121 having a substantially perfect circular shape. The protruding section fixing portion 122 is a portion extended from the protruding section insertion portion 121 in a direction orthogonal to a direction of inserting the protruding section 221. When T1 represents an opening diameter of the protruding section insertion portion 121 and T2 represents the opening width of the protruding section fixing portion 122, a relation of T1>T2 is satisfied. In the example illustrated in FIG. 3, the protruding section fixing portion 122 is extended (or shifted) in a rightward direction (+X direction) from the protruding section insertion portion 121, but the protruding section fixing portion 122 may be extended (or shifted) in a lateral direction (±X direction), an up-and-down direction (±Z direction), or an oblique direction in FIG. 3. However, in order to alleviate a burden on a user, it is desired that the protruding section fixing portion 122 be shifted from the protruding section insertion portion 121 in the lateral direction (±X direction) or a downward direction (−Z direction). In particular, in view of fixation of the bottle, it is preferred that the protruding section fixing portion 122 be extended from the protruding section insertion portion 121 in the downward direction that is a downward direction of gravitation. The protruding section 221 is slidable between the protruding section insertion portion 121 and the protruding section fixing portion 122 in the liquid injection port 12, and the sliding direction of the protruding section 221 is orthogonal to the direction of inserting the protruding section 221 into the liquid injection port 12. In this specification, when a shape of an opening is a perfect circle, the "opening diameter" means a diameter of the opening. When a shape of an opening is not a perfect circle, the "opening diameter" refers to a diameter equivalent to a diameter of a perfect circle. The "opening width" of the protruding section fixing portion refers to a width of an opening portion of the protruding section fixing portion on which the protruding section of the bottle is caught. In the mode illustrated in FIG. 3, the protruding section insertion portion 121 is circular, and the diameter of the protruding section insertion portion 121 corresponds to the "opening diameter". Further, the protruding section fixing portion 122 extends rightward from a center of the protruding section insertion portion 121, and a width of the protruding section fixing portion 122 in a direction perpendicular to a line connecting the center of the protruding section insertion portion 121 and a center of gravity of the protruding section fixing portion 122 to each other corresponds to the "opening width". The protruding section insertion portion 121 and the protruding section fixing portion 122 are continuous with each other, and define one opening together. When the protruding section insertion portion 121 is circular, a portion protruding from an outer periphery of the circular protruding section insertion portion 121 corresponds to the protruding section fixing portion 122.

Figure 4:
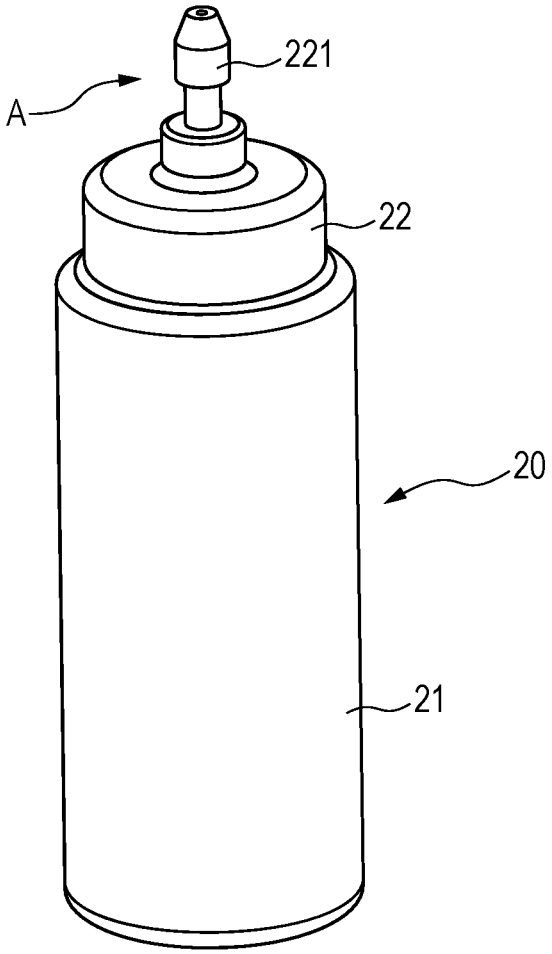
FIG. 4 is a perspective view for illustrating a bottle according to the first embodiment of the present invention.
Figure 5:
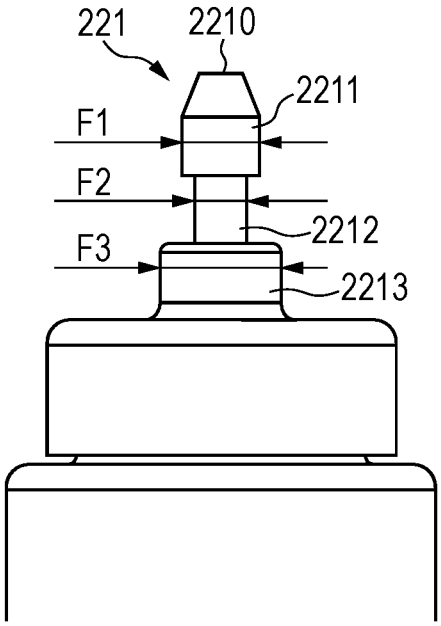
FIG. 5 is an enlarged view for illustrating relevant parts of the bottle of FIG. 4.

The bottle 20 for liquid replenishment according to the present invention illustrated in FIG. 4 mainly includes a bottle section 21 configured to store the liquid, and a cap 22 configured to close an opening of the bottle section 21. The protruding section (nozzle) 221 having a small diameter is formed on the cap 22. The protruding section 221 is configured to inject the liquid into the tank 10. FIG. 5 is an enlarged view for illustrating the protruding section 221 of FIG. 4 seen from the arrow A direction. The protruding section 221 includes a first protruding portion that is located on a distal end side of the protruding section 221, and a second protruding portion that is located on the bottle section side with respect to the first protruding portion and has an outer diameter smaller than an outer diameter of the first protruding portion. In the example illustrated in FIG. 5, the protruding section 221 includes a distal end portion 2211 being the first protruding portion, and an intermediate portion 2212 being the second protruding portion. The distal end portion 2211 and the intermediate portion 2212 are aligned in a longitudinal direction (insertion direction) of the protruding section 221. The protruding section 221 further includes a root portion 2213. That is, the protruding section 221 is divided into the three portions. The intermediate portion 2212 is formed continuously with the distal end portion 2211, and the root portion 2213 is formed continuously with the intermediate portion 2212 on an opposite side of the distal end portion 2211. The distal end portion 2211 is formed at a distal end of the protruding section, and a top of the distal end portion 2211 in the insertion direction corresponds to a top 2210. When F1, F2, and F3 represent a maximum outer diameter of the distal end portion 2211, a maximum outer diameter of the intermediate portion 2212, and a maximum outer diameter of the root portion 2213 of the protruding section 221, respectively, it is preferred that relations of F1>F2, F3>F2, T1>F1, F1>T2, and F3>T1 be satisfied. Here, description is made of the example in which the protruding section 221 includes the three portions, that is, the distal end portion 2211, the intermediate portion 2212, and the root portion 2213. However, the protruding section 221 may include no root portion 2213. For example, the root portion 2213 is not formed, and the second protruding portion is formed at a position adjacent to the bottle section 21 or the cap 22.

Figure 6A:
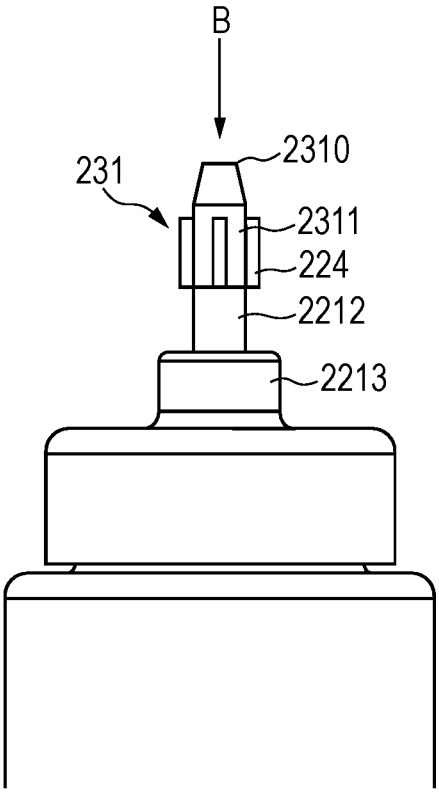
FIG. 6A and FIG. 6B are enlarged views for illustrating relevant parts of a bottle according to a modification example of the first embodiment of the present invention.
Figure 6B:
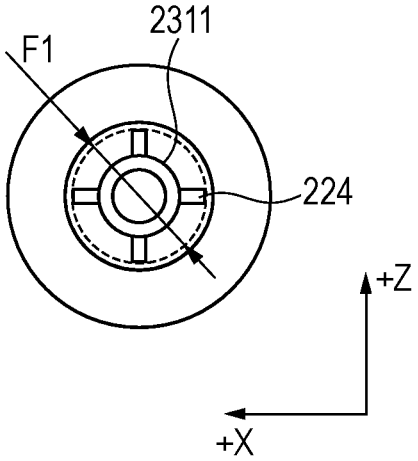

The distal end portion 2211 of the protruding section may have a shape other than a circular shape. FIG. 6A and FIG. 6B are illustrations of a protruding section 231 according to a modification example of the first embodiment. FIG. 6A is a view for illustrating the protruding section 231 seen from the arrow A direction of FIG. 4, and FIG. 6B is a schematic view for illustrating the protruding section 231 seen from the arrow B direction of FIG. 6A. As illustrated in FIG. 6A and FIG. 6B, a distal end portion 2311 of the protruding section 231 is not circular, but includes protrusions 224 on four sides. At this time, a diameter of an imaginary circle drawn by connecting vertices of the four protrusions 224 corresponds to the maximum outer diameter F1. Similarly to the example illustrated in FIG. 5, it is preferred that the relations of F1>F2, F3>F2, T1>F1, F1>T2, and F3>T1 be satisfied.

Figure 7:
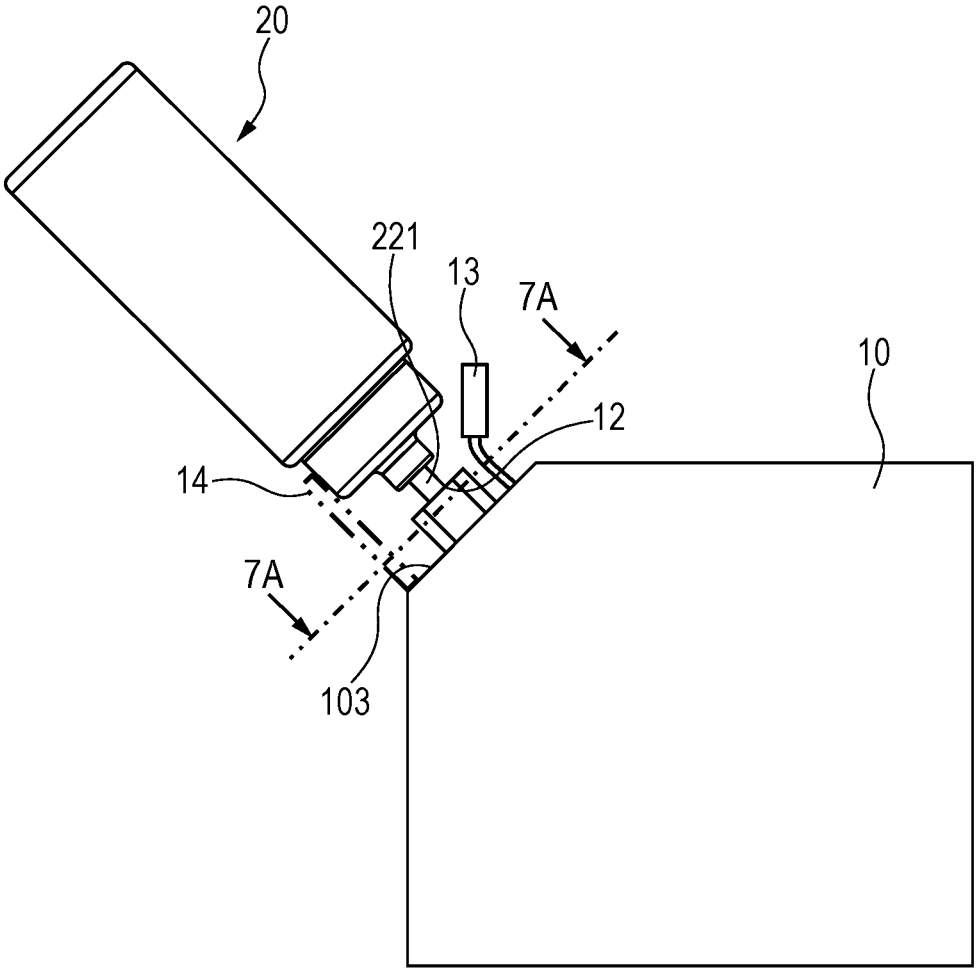
FIG. 7 is a side view for illustrating a liquid supplying state according to the first embodiment of the present invention.
Figure 8A:
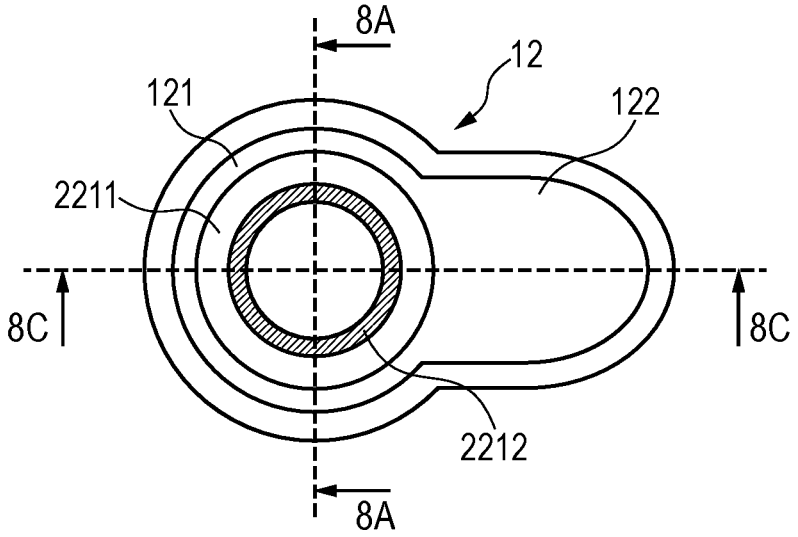
FIG. 8A and FIG. 8B are schematic plan views for sequentially illustrating features of a liquid supplying method according to the first embodiment of the present invention.
Figure 8B:
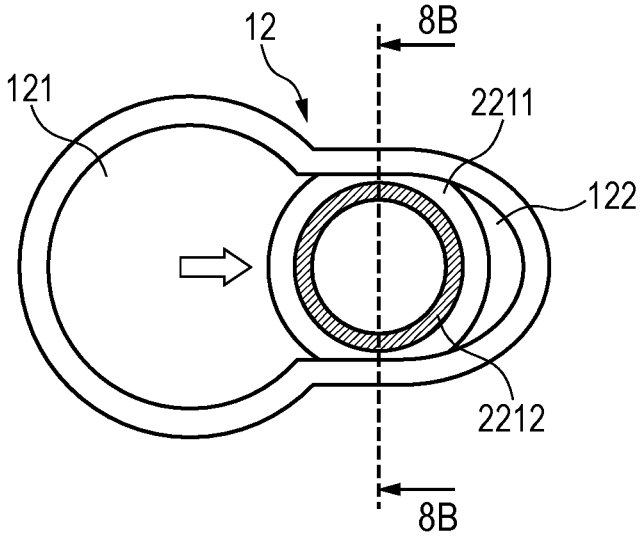

The tank 10 including the liquid injection port 12 having the above-mentioned shape and dimension, and the bottle 20 including the protruding section 221 or 231 having the above-mentioned shape and dimension construct a liquid supplying mechanism according to the first embodiment. A liquid supplying method performed by the liquid supplying mechanism is described with reference to FIG. 7 to FIG. 9B. In the following, description is made of the liquid supplying method performed by the liquid supplying mechanism including the bottle 20 including the protruding section 221 illustrated in FIG. 4 and FIG. 5. However, also in a case of using the liquid supplying mechanism including the bottle 20 including the protruding section 231 illustrated in FIG. 6A and FIG. 6B, the liquid is supplied in the same way as a way described below. FIG. 7 is a view seen from a side of the tank, for illustrating a state in which the protruding section 221 of the bottle is inserted into the liquid injection port 12 of the tank 10. FIG. 8A and FIG. 8B are sectional views taken along the line 7A-7A of FIG. 7. FIG. 8A is a sectional view for illustrating a state in which the protruding section 221 is inserted into the liquid injection port 12, and FIG. 8B is a sectional view for illustrating a state in which the bottle 20 is fixed into the liquid injection port 12 and the liquid is injected into the tank. Further, FIG. 9A1 and FIG. 9A2 are sectional views taken along the line 8A-8A of FIG. 8A. FIG. 9A1 is a sectional view for illustrating a state in which the protruding section 221 is inserted into the liquid injection port 12, and FIG. 9A2 is a sectional view for illustrating a state in which the protruding section 211 is further advanced into the liquid injection port 12. FIG. 9B is a sectional view taken along the line 8B-8B of FIG. 8B.

As illustrated in FIG. 8A and FIG. 9A1, when the protruding section 221 is mounted into the liquid injection port 12, first, the distal end portion 2211, which has the maximum outer diameter F1, of the protruding section 221 is inserted into the protruding section insertion portion 121, which has the opening diameter T1, of the liquid injection port 12. When the opening diameter T1 of the protruding section insertion portion 121 is larger than the maximum outer diameter F1 of the distal end portion 2211, the distal end portion 2211 can be easily inserted into the protruding section insertion portion 121. As illustrated in FIG. 9A2, when the protruding section 221 is further advanced from this state, the distal end portion 2211 passes through the protruding section insertion portion 121 of the liquid injection port 12. Then, the root portion 2213, which has the maximum outer diameter F3, comes into abutment on an inner peripheral edge of the protruding section insertion portion 121. As a result, the protruding section 221 cannot be deeply inserted into the tank any further. Thus, a user can perceive that the protruding section 221 has been fully inserted into the tank. Then, as illustrated in FIG. 8B, a user moves the protruding section 221 from the protruding section insertion portion side to the protruding section fixing portion side of the liquid injection port 12 in the direction orthogonal to the direction of inserting the protruding section 221. In this manner, the intermediate portion 2212 of the protruding section 221 is positioned to be opposed to the protruding section fixing portion 122. An inner peripheral edge portion, which has the opening width T2, of the protruding section fixing portion 122 is sandwiched between the distal end portion 2211, which has the maximum outer diameter F1, and the root portion 2213, which has the maximum outer diameter F3, of the protruding section 221.

As illustrated in FIG. 9B, the opening width T2 of the protruding section fixing portion 122 is smaller than the maximum outer diameter F1 of the distal end portion 2211 of the protruding section 221. Even when a force is applied in a direction of pulling the protruding section 221 out of the liquid injection port 12, the protruding section 221 is prevented from slipping out of the liquid injection port 12 because the distal end portion 2211 having the maximum outer diameter F1 is caught on the inner peripheral edge of the protruding section fixing portion 122 having the opening width T2. Further, the protruding section 221 is prevented from being overly deeply inserted into the liquid injection port 12 in such a manner that the root portion 2213 having the maximum outer diameter F3 comes into abutment on the inner peripheral edge of the protruding section fixing portion 122 having the opening width T2. In this manner, the protruding section 221 is fixed into the liquid injection port 12 under a state in which the inner peripheral edge of the protruding section fixing portion 122 is positioned between the distal end portion 2211 and the root portion 2213. Therefore, the bottle 20 is retained without being held by a user, and a burden on a user is alleviated during replenishment of the liquid from the bottle 20 into the tank 10. However, as described above, there may be adopted such a configuration that no root portion 2213 is formed and the intermediate portion 2212 is directly continuous with the bottle section 21.

Description is made above of the example in which the bottle 20 is fixed to the tank 10 by fixing the protruding section 221 of the bottle 20 into the liquid injection port 12 that includes the protruding section insertion portion 121 having a large opening diameter, and the protruding section fixing portion 122 having a small opening width. In the present invention, it is only necessary that the bottle 20 can be fixed to the tank 10 by inserting the protruding section 221 of the bottle 20 into the protruding section insertion portion 121, and then fixing the protruding section 221 in the protruding section fixing portion 122.

As schematically illustrated in FIG. 7 by the two-dot chain line, it is preferred to adopt such a configuration that a support portion 14 is protruded from the tank 10 and is configured to support at least a part of the bottle 20 from below under a state in which the protruding section 221 is engaged with and fixed in the protruding section fixing portion 122. This is because reliability of support of the bottle 20 is enhanced.

It is preferred that the bottle 20 be mounted to the tank 10 in an obliquely downward direction that is oblique to a vertical direction and a horizontal direction. When the bottle 20 is mounted to the tank 10 in the horizontal direction or in an upward direction, it is difficult for the liquid in the bottle 20 to flow into the tank. When the bottle 20 is mounted to the tank 10 in a vertically downward direction, the liquid easily flows, but a user needs to perform mounting work of the bottle 20 from directly above the tank 10. Thus, workability is low, and the liquid may spill during the mounting work. In view of easy flow of the liquid from the bottle 20 into the tank 10, workability of mounting of the bottle 20 to the tank 10, and prevention of spill of the liquid during the work, the bottle 20 is mounted to the tank 10 in the obliquely downward direction as illustrated in FIG. 7. Accordingly, as illustrated in FIG. 2 and FIG. 7, an upper portion of the tank 10 in an in-use posture (predetermined posture) has a tapered shape tapered in a vertically upward direction, and the liquid injection port 12 is formed in an inclined surface (bottle mounting portion 103 illustrated in FIG. 7) defining the tapered shape. When the bottle section 21 of the bottle 20 mounted to the tank lowers due to gravity under a state in which the tank is in the in-use posture, at a point in time when an upper portion of the distal end portion 2211 comes into abutment on the inner peripheral edge of the protruding section fixing portion 122, the bottle section 21 is inhibited from further lowering so that the bottle 20 is fixed. When a difference between the opening width T2 of the protruding section fixing portion 122 and the maximum outer diameter F2 of the intermediate portion 2212 is slight, the protruding section 221 is merely tilted slightly with respect to a vertical direction (or the insertion direction) so that the distal end portion 2211 comes into abutment on the inner peripheral edge of the protruding section fixing portion 122. Thus, the bottle 20 is not tilted any further. Accordingly, the bottle 20 is more easily fixed to the tank 10, and the bottle 20 is more easily prevented from falling out of the tank 10. Thus, a burden on a user is further alleviated.

As illustrated in FIG. 3, FIG. 8A, and FIG. 8B, it is preferred that, at least under a state in which the tank 10 is in the in-use posture (predetermined posture), a center point of the protruding section fixing portion 122 be vertically flush with a center point of the protruding section insertion portion 121, or vertically lower than the center point of the protruding section insertion portion 121. If the center point of the protruding section fixing portion 122 is vertically higher than the center point of the protruding section insertion portion 121, there is a fear in that the protruding section 221 moves (descends) to the protruding section insertion portion 121 side due to gravity from a state of being engaged with and fixed in the protruding section fixing portion 122. When the protruding section 221 moves as described above, the protruding section 221 can slip out of the protruding section insertion portion 121. Thus, it is conceivable that the bottle 20 may be unintentionally disengaged from the tank 10. In order to prevent the disengagement, in the first embodiment, the center point of the protruding section fixing portion 122 is arranged vertically flush with or lower than the center point of the protruding section insertion portion 121. This configuration prevents the protruding section 221 from moving from the protruding section fixing portion 122 side to the protruding section insertion portion 121 side due to gravity. Thus, the bottle 20 can be more satisfactorily prevented from being disengaged from the tank 10. The center point described herein means a center of gravity of each portion.

Figure 10:
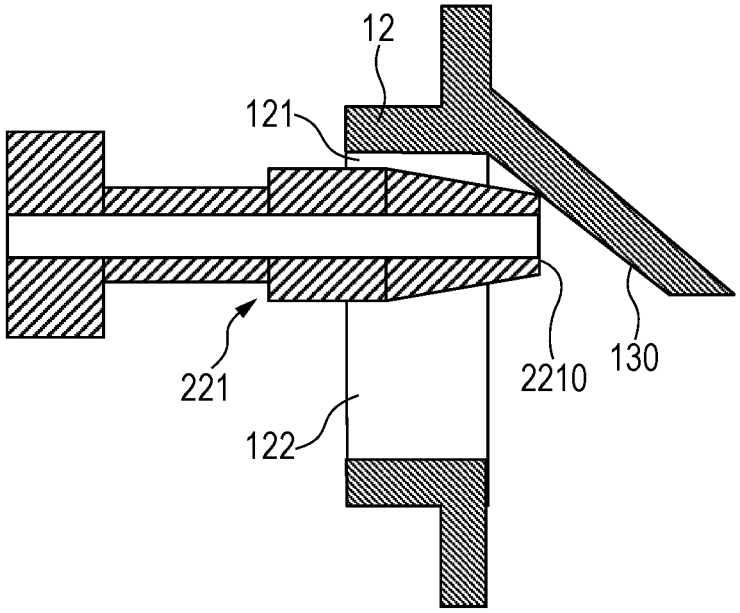
FIG. 10 is a schematic sectional view for illustrating a modification example of the first embodiment of the present invention taken along the line 8C-8C of FIG. 8A.

FIG. 10 is a sectional view for illustrating a modification example of the first embodiment taken along the line 8C-8C of FIG. 8A. In the modification example illustrated in FIG. 10, on a deep side of the liquid injection port 12 in the insertion direction, a guide inclined surface 130 is formed so as to extend in an inclined manner from the protruding section insertion portion 121 side to the protruding section fixing portion 122 side into a deep portion of the liquid storage section 11. As the protruding section 221 is advanced into the deep portion of the tank 10, the guide inclined surface 130 formed on an inside of the tank 10 causes the top 2210 of the protruding section 221 to slide while coming into abutment on the guide inclined surface 130. Further, a force is applied in a direction of moving the protruding section 221 from the protruding section insertion portion 121 side to the protruding section fixing portion 122 side. Therefore, a user does not need to intentionally and forcibly move the protruding section 221 from the protruding section insertion portion 121 side to the protruding section fixing portion 122 side. As a result, operability is enhanced, and a burden on a user is further alleviated.

Second Embodiment

Figure 11:
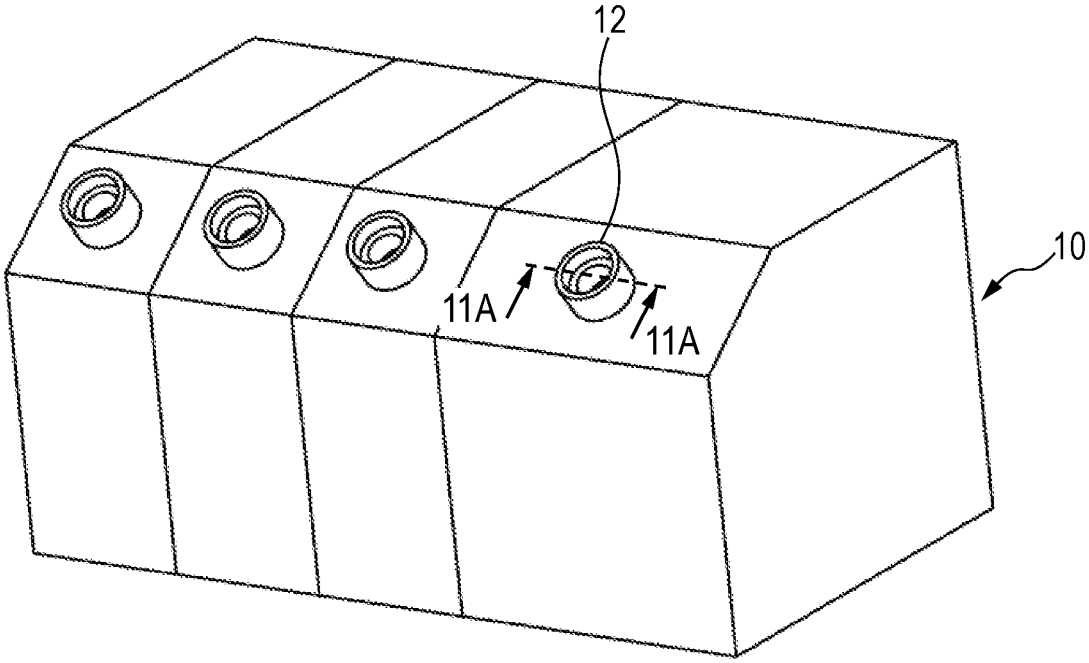
FIG. 11 is a perspective view for illustrating liquid storage containers according to a second embodiment of the present invention.
Figure 12:
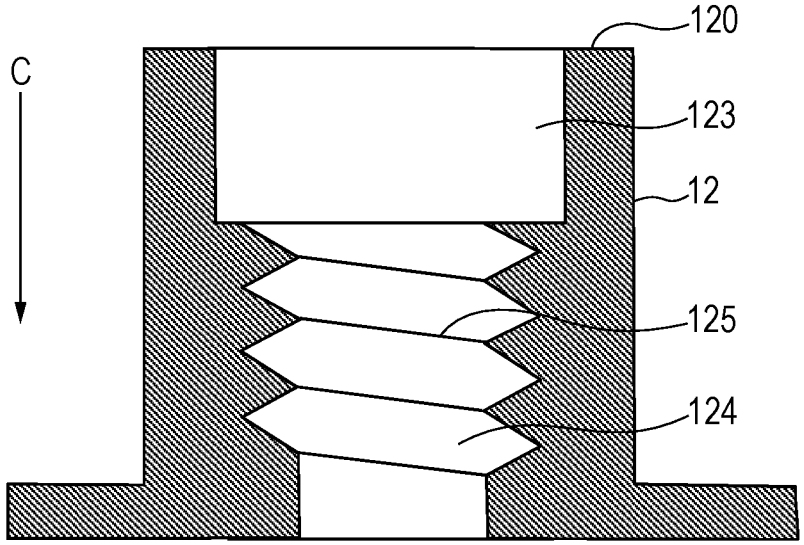
FIG. 12 is a sectional view for illustrating a liquid injection port of one liquid storage container of FIG. 11.

A second embodiment of the present invention is described. FIG. 11 is a perspective view for illustrating the tanks 10 according to the second embodiment of the present invention. FIG. 12 is a sectional view for illustrating the liquid injection port 12 taken along the line 11A-11A of FIG. 11. The liquid injection port 12 according to the second embodiment includes a protruding section insertion portion 123 and a protruding section fixing portion 124. The protruding section insertion portion 123 is open in one surface of the tank, and is formed into a cylindrical hole extending toward the deep portion of the tank from an opening end 120 of a cylindrical portion outwardly protruding from the bottle mounting portion 103. The protruding section fixing portion 124 is formed in a deeper portion of the cylindrical portion than the protruding section insertion portion 123. An internal thread portion 125 is formed in an inner peripheral surface of the protruding section fixing portion 124. That is, the opening end 120 having a perfect circular shape, the protruding section insertion portion 123 formed into the cylindrical hole, and the protruding section fixing portion 124 including the internal thread portion 125 are formed continuously along a direction (arrow C direction of FIG. 12) of inserting the protruding section, and are substantially concentric with one another. The protruding section fixing portion 124 is bottomless, and is communicated to the liquid storage section 11.

Figure 13:
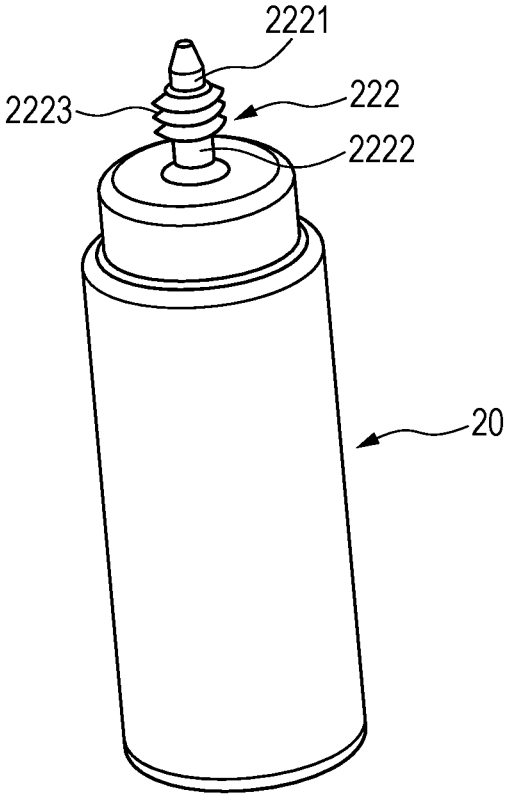
FIG. 13 is a perspective view for illustrating a bottle according to the second embodiment of the present invention.

FIG. 13 is a perspective view for illustrating the bottle 20 according to the second embodiment. A protruding section 222 includes a distal end portion 2221 and an intermediate portion 2222 formed continuously with each other along a longitudinal direction of the protruding section 222 in the stated order from a distal end side of the protruding section 222. An external thread portion 2223 is formed in an outer peripheral surface of the intermediate portion 2222 so as to be threadingly engageable with the above-mentioned internal thread portion 125 of the protruding section fixing portion 124 of the liquid injection port 12. When F4 represents a maximum outer diameter of the distal end portion 2221 of the protruding section 222 and T3 represents an opening diameter of the protruding section insertion portion 123 of the liquid injection port 12, a relation of T3>F4 is satisfied. The other components are the same as those of the first embodiment, and hence description thereof is omitted.

Figure 14:
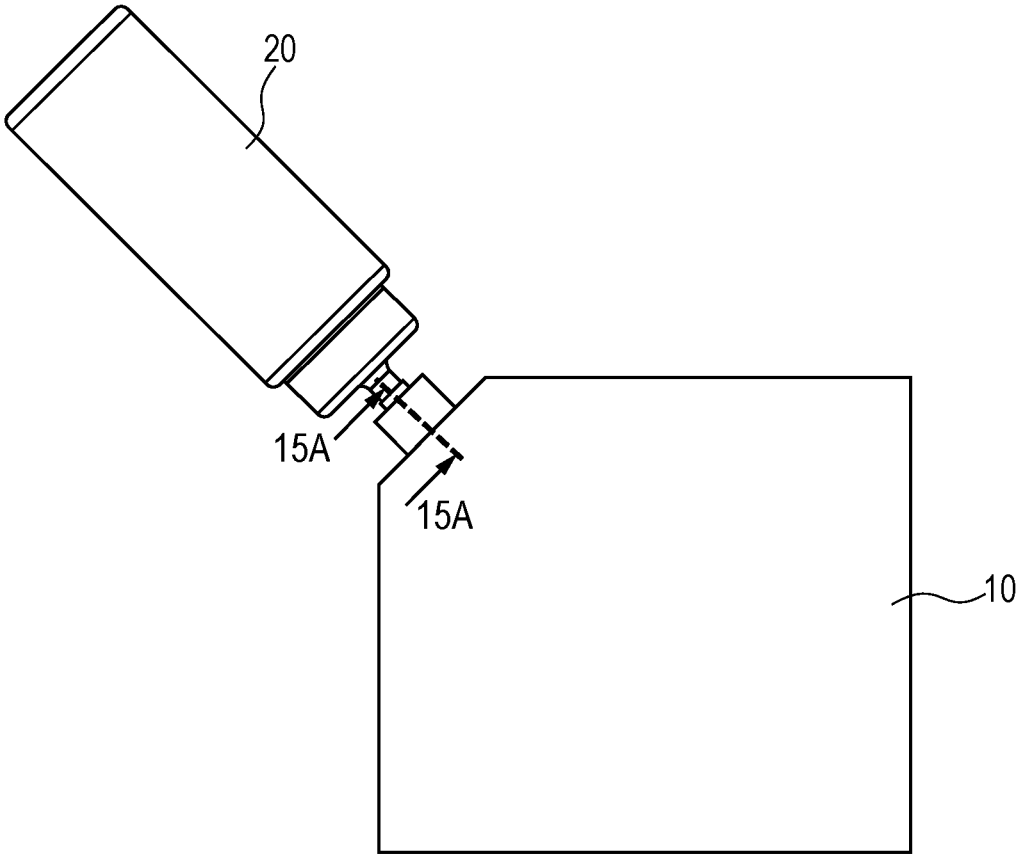
FIG. 14 is a side view for illustrating a liquid supplying state according to the second embodiment of the present invention.
Figure 15A:
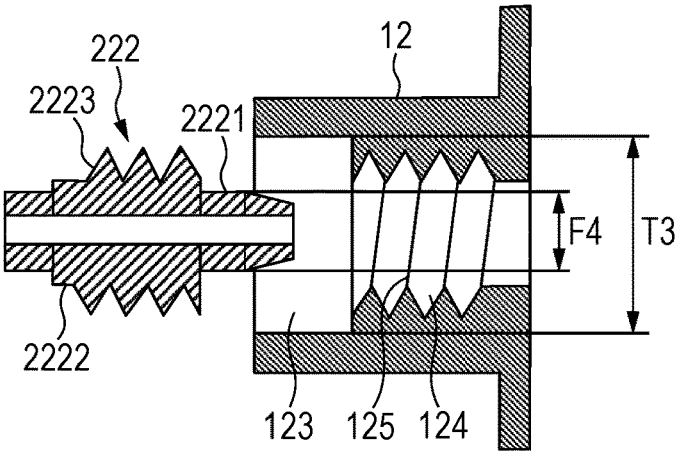
FIG. 15A, FIG. 15B, and FIG. 15C are sectional views for sequentially illustrating features of a liquid supplying method according to the second embodiment of the present invention.
Figure 15B:
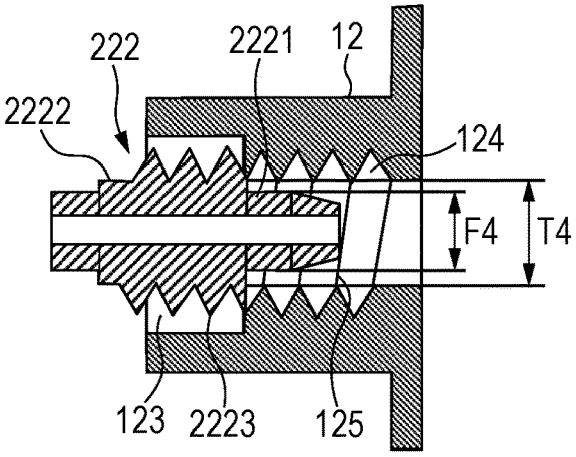
Figure 15C:
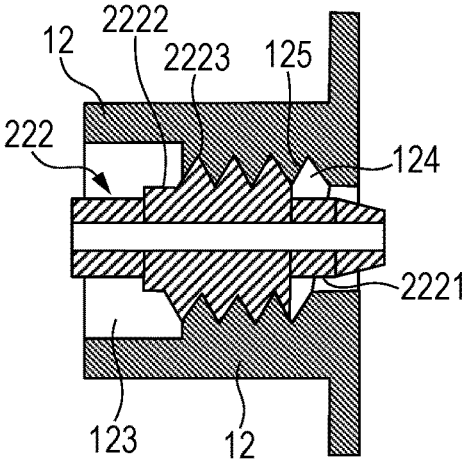

With reference to FIG. 14 and FIG. 15A to FIG. 15C, description is made of a liquid supplying method of injecting the liquid from the bottle 20 including the protruding section 222 illustrated in FIG. 13, into the tank 10 in which the liquid injection port 12 illustrated in FIG. 12 is formed. FIG. 14 is a view seen from a side of the tank, for illustrating a state in which the protruding section 222 of the bottle 20 is inserted into the liquid injection port 12 of the tank 10. FIG. 15A to FIG. 15C are sectional views for sequentially illustrating steps of mounting the protruding section 222.

First, as illustrated in FIG. 15A, the distal end portion 2221 of the protruding section 222 is inserted through the opening end 120 into the protruding section insertion portion 123 of the liquid injection port 12. At this time, when the maximum outer diameter F4 of the distal end portion 2221 is smaller than the opening diameter T3 of the protruding section insertion portion 123, the protruding section 222 can be easily inserted into the liquid injection port 12.

Next, the protruding section 222 is further advanced into the deep portion of the tank 10, and the distal end portion 2221 is moved into the protruding section fixing portion 124 so that the intermediate portion 2222 reaches the protruding section fixing portion 124. When an opening diameter T4 of the protruding section fixing portion 124 of the liquid injection port 12 is sufficiently larger than the maximum outer diameter F4 of the distal end portion 2221, the protruding section 222 is easily inserted into the liquid injection port 12. Accordingly, until the intermediate portion 2222 reaches the protruding section fixing portion 124 through the protruding section insertion portion 123, a user can perform operation while hardly feeling any load. As illustrated in FIG. 15B, when the distal end portion 2221 is deeply inserted into the protruding section fixing portion 124 and then the internal thread portion 125 of the protruding section fixing portion 124 and the external thread portion 2223 of the intermediate portion 2222 come into abutment on each other, movement of the protruding section 222 in the insertion direction is temporarily stopped. At this time, a user perceives that the distal end portion 2221 has been inserted into the protruding section fixing portion 124 so that the intermediate portion 2222 has reached the protruding section fixing portion 124. Thus, as illustrated in FIG. 15C, while turning the bottle 20, a user further advances the protruding section 222 into the deep portion of the tank 10. As a result, the external thread portion 2223 of the intermediate portion 2222 is screwed into the internal thread portion 125 of the protruding section fixing portion 124. In this manner, the protruding section 222 is fixed in the liquid injection port 12. The protruding section 222 is not disengaged from the liquid injection port 12 unless a user turns the bottle in the opposite direction. Accordingly, during injection of the liquid, a user does not need to hold the bottle 20 so as to prevent fall of the bottle 20, with the result that a burden during injection of the ink can be alleviated.

As described above, according to the present invention, when the bottle 20 is fixed to the tank 10, first, the protruding section 221, 222, or 231 of the bottle 20 is easily inserted into the protruding section insertion portion 121 or 123 of the liquid injection port 12. Then, the protruding section 221, 222, or 231 is further moved, and is engaged with the protruding section fixing portion 122 or 124 so that the protruding section 221, 222, or 231 is fixed. That is, unless the protruding section 221, 222, or 231 is moved from the protruding section fixing portion 122 or 124 side back to the protruding section insertion portion 121 or 123 side, the protruding section 221, 222, or 231 does not slip out of the liquid injection port 12. Accordingly, the bottle 20 is fixed with high reliability. In addition, under a state in which the protruding section 221, 222, or 231 is fixed in the protruding section fixing portion 122 or 124, even when a user does not hold the bottle 20, the bottle 20 is fixed to the tank 10. Therefore, a burden on a user during supply of the liquid can be significantly alleviated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-128728, filed Jun. 29, 2016, and Japanese Patent Application No. 2017-065461, filed Mar. 29, 2017, which are hereby incorporated by reference herein in their entirety.

What is claimed is:

1. A method for injecting an ink to a tank storing the ink supplied to an ink jet head from a bottle storing the ink for replenishment, in which the bottle comprises a protruding section, which derives the ink for replenishment to the tank, and the tank comprises an ink injection port into which the protruding section is inserted and the ink injection port fixes the bottle, wherein the ink injection port comprises:

a protruding section insertion portion into which the protruding section of the bottle is insertable, and a protruding section fixing portion fixing the protruding section, wherein the method comprises:

an inserting step of inserting the protruding section of the bottle into the protruding section insertion portion, a fixing step of fixing the bottle with the protruding section fixing portion by moving the protruding section from the protruding section insertion portion to the protruding section fixing portion in a direction orthogonal to a direction of inserting the protruding section, and an injecting step of injecting the ink from the bottle to the tank under the condition which the bottle is fixed with the protruding section fixing portion.

2. A method for injecting an ink according to claim 1, in which the tank has an approximately rectangular parallelepiped shape, the tank has an inclined surface having the tapered shape tapered in a vertically upward direction in the predetermined posture under use of the tank, and the ink injection port is formed in the inclined surface, wherein, in the fixing step, the bottle is fixed to the tank in an obliquely downward direction.

3. A method for injecting an ink according to claim 1, in which the center point of the protruding section fixing portion is arranged vertically flush with the center point of the protruding section insertion portion in the predetermined posture under use of the tank, wherein, in the fixing step, the protruding section is moved to a horizontal direction.

4. A method for injecting an ink according to claim 1, in which a guide inclined surface formed on a deep side of the liquid injection port in the insertion direction of the bottle extends in an inclined manner from the protruding section insertion portion to the protruding section fixing portion into a deep portion of the tank, wherein, in the inserting step, a top of the protruding section abuts on the guide inclined surface when the protruding section is inserted into the protruding section insertion portion, and as the protruding section is further advanced into the deep portion of the tank, the bottle is guided from the protruding section insertion portion to the protruding section fixing portion by sliding the top of the protruding section along with the guide inclined surface.

5. A printer comprising:

a tank comprising:

an ink storage section configured to store an ink supplied to an ink jet head, and an ink injection port configured to be inserted by an ink bottle storing an ink for replenishment, and to keep the condition that the bottle is fixed with injection port, wherein the ink injection port comprises:

a first opening into which the ink bottle is insertable, and a second opening configured to fix the bottle, wherein the second opening is formed continuously with the first opening in order that the bottle is able to move in a direction orthogonal to a direction of inserting the bottle.

6. A printer according to claim 5, wherein the ink tank has an approximately rectangular parallelepiped shape, the ink tank has an inclined surface having the tapered shape tapered in a vertically upward direction in the predetermined posture under use of the ink tank, and the ink injection port is formed in the inclined surface.

7. A printer according to claim 5, wherein the first opening is arranged vertically flush with the second opening.

8. A printer according to claim 5, wherein a guide inclined surface is formed in the ink tank, and the guide inclined surface is arranged so that a distance between the ink injection port and the guide inclined surface is gradually elongated from the first opening to the second opening.

9. A printer according to claim 5, wherein the ink injection port is formed in approximate gourd-shaped in which an opening diameter of first opening is relatively larger than an opening diameter of the second opening.

10. A printer comprising:

a tank comprising:

an ink storage section configured to store an ink supplied to an ink jet head, and an ink injection port configured to keep the condition that the bottle is fixed with injection port, wherein the ink injection port is formed on an exterior wall surface of the ink storage section, and the ink injection port comprises a first opening and a second opening being formed continuously with the first opening, and the ink injection port is formed in approximate gourd-shaped in which an opening diameter of first opening is relatively larger than an opening diameter of the second opening.

* * * * *